United States Patent [19]

Kushmaul et al.

[11] 4,427,192

[45] Jan. 24, 1984

[54] DISPENSER VACUUM SYSTEM

[75] Inventors: Richard T. Kushmaul, Dallas; James E. Webb, Richardson, both of Tex.

[73] Assignee: Docutel Corporation, Irving, Tex.

[21] Appl. No.: 297,613

[22] Filed: Aug. 31, 1981

[51] Int. Cl.[3] ..... B65H 3/08

[52] U.S. Cl. ..... 271/11; 271/98; 271/107; 271/108; 417/531; 417/534

[58] Field of Search ..... 271/98, 100, 101, 102, 271/106, 107, 108, 105, 11, 12; 417/534, 521, 531, 525

[56] References Cited

U.S. PATENT DOCUMENTS

| | | | |
|---|---|---|---|
| 665,222 | 1/1901 | Isler | 417/534 |
| 2,042,673 | 6/1936 | Maniscalco | 417/525 X |
| 2,509,022 | 5/1950 | Turnquist | 417/534 |
| 4,090,702 | 5/1978 | Wirz | 271/108 |
| 4,248,417 | 2/1981 | Fujimoto | 271/98 |

*Primary Examiner*—Richard A. Schacher
*Attorney, Agent, or Firm*—Harold E. Meier

[57] ABSTRACT

Automatic terminal machines for banking transactions utilize a document dispenser for delivering bank notes to a customer. The document dispenser moves the bank notes from a storage bin by means of a picker mechanism that moves along a path profile established by the configuration of a pair of cam tracks and associated cam followers. The picker mechanism includes vacuum cups for lifting the first document from a stack in the storage bin for delivery into a document transport. Connected to the vacuum cups is a vacuum/pressure supply that includes a multiple chamber cylinder that provides both vacuum and pressure synchronized with operation of the picker mechanism. The piston is pivotally mounted to enable swivel action when driving the interconnected pistons in respective chambers. When provided, the document dispenser includes a cassette having a loading door and an unloading door, each separately equipped with a locking device. These locking devices provide a tamper-proof cassette configuration when the cassette is removed from the dispenser for servicing. The various locking devices are released by locking the cassette housing into the document dispenser.

10 Claims, 17 Drawing Figures

10
16
28
48
52
54
55
58
60
62
64
74
78
80
84
86
88
100
102
104
106
108
110
112
114
118
120
122
124
126
128

DISPENSER VACUUM SYSTEM

TECHNICAL FIELD

This invention relates to a document dispenser, and more particularly to apparatus and a method of controlling the dispensing of bank notes from a banking machine.

BACKGROUND ART

Automatic banking machines, commonly known as ATM's (automatic terminal machine), are now an accepted way of performing many personal banking financial transactions. There are many reasons advanced for this change from conventional banking for completing financial transactions to the use of automatic banking machines. One of the more significant advantages is its availability on a 24-hour basis, thus providing banking services to a customer at the customer's convenience. The convenience of 24-hour availability, as well as the ability of being operated at numerous locations, where such service would not otherwise be feasible, is possible because such machines are self-operated in that they function on the command of the customer. Because such banking machines are "self-operating", a system must be accurate, substantially error free, reliable, and capable of dispensing bank notes upon command by the customer in a convenient form and in quantities selected by the customer.

With the increased use of automatic banking machines it has become evident that the reliability of such machines is of importance for customer acceptance, particularly when the dispenser is self-operating and unattended in any direct manner. Considerable customer inconvenience may result if a banking machine fails to operate upon the presentation of a customer identification card as a result of the malfunctioning of the system.

It is also important from the operator's (e.g. a bank) point of view that only the correct quantity of bank notes should be delivered to the customer for such automatic banking machines to be acceptable. A banking machine dispensing bank notes must operate to minimize the possibility of delivering more notes to the customer than selected. Some prior art automatic banking machines utilized a "fail safe" operation that shut down the machine upon the detection of a malfunction, such as a bank note misfeed, but such a solution causes obvious inconvenience and loss of service of the machine.

Other prior art automatic banking machines dispense bank notes in selected quantities to a drawer which is subsequently opened to the customer to permit withdrawal of the bank notes. These systems permitted selected withdrawal of varied amounts of bank notes. Once a note is dispensed from a storage bin into the drawer there is no means of retracting the note when an error in dispensing has been made. Such machines require the "fail safe" operation as mentioned previously. Other automatic banking machines provide for the successive counting out of bank notes from a storage bin directly to a customer. The present invention will be described with reference to this type of automatic banking machine although the document dispenser to be described also finds utility when delivering individual bank notes successively to an escrow station. An automatic banking machine with an escrow station operates to deliver bank notes from a storage bin to the escrow station. All bills in the escrow station are then delivered as a bundle to a customer when the correct number has been assembled in escrow.

DISCLOSURE OF THE INVENTION

In accordance with the present invention there is provided a document dispenser that reliably and accurately dispenses bank notes from a storage bin to a customer at an exit throat. Individual notes are fed from the storage bin by means of a vacuum pickup that delivers the note to a transport that selectively returns all but one bank note to the storage bin and transports only a single bill to the customer. Included as a part of the mechanism for picking up individual bank notes from the storage bin is a pivotally mounted pump providing both vacuum and pressure during one cycle of picking up a bank note from the storage bin. As the vacuum pickup lifts the bill into the transport the air pressure ruffles the edge of the note to further insure that only a single bank note is delivered into the transport system.

Further, in accordance with the present invention, accuracy of dispensing bank notes is achieved by actuating a pickup head constrained to move along a path that includes a first rocking motion followed by a linear lifting. The initial rotation of the pickup head is intended to provide more positive separation of the top bank note in a stack.

Although not limited thereto, a document dispenser in accordance with the present invention may include a tamper proof cassette comprising the storage bin. This cassette is equipped with an elevator for continuously positioning a bundle of bank notes therein to an unloading door. However, before the unloading door can be opened or the elevator operated the cassette must be locked in place in the bank note dispenser. This locking in place prior to opening the unloading door and movement of the elevator is provided by mechanical interlock.

In accordance with the present invention, the vacuum/pressure supply for the document dispenser includes a cylinder having multiple chambers each containing a sliding piston. The piston of each chamber is interconnected to the piston in other chambers such that all pistons operate as a single unit. Each chamber includes a first port opening therein with all such ports located on the same side of the piston in the respective chambers. Each such port is interconnected into a single vacuum/pressure supply source for the document dispenser and connected to a pickup head in the bank note storage bin. The cylinder of the vacuum/pressure supply is pivotally mounted to enable swivel action when driving the interconnected pistons relative to the respective chambers.

Further, in accordance with the present invention, a document dispenser for moving documents from a storage bin into a document transport includes a picker head having vacuum cups for lifting the first document from a stack in the storage bin for delivery into the document transport. To guide the movement of the picker head the document dispenser includes a cam track and a guide track positioned relative to the cam track. A first follower is mounted in the cam track for movement along a path determined by the configuration of this track. A second follower is mounted in the guide track and moves along a path determined by the track configuration. A support carries the picker head to be positioned above the first document of the stack by means of the first and second followers mounted thereto. This constrains the support for movement along a path profile established by the configuration of the respective tracks. To impart to the picker head an initial rotational motion the cam track includes a first camming surface which is contiguous with a second camming surface with the first camming surface establishing the initial movement of a document to the document transport. To impart a pre-established angular orientation to the picker head during movement thereof the guide track and the cam track are positioned at an angle with respect to the top document of the stack.

When provided, the document dispenser includes a cassette having a housing for holding a supply of documents in a stacked configuration. The housing includes a loading door having a locking device and an unloading door also equipped with a locking device. The housing is secured in the document dispenser by locking means prior to unloading documents from the cassette. Responsive to the locking means is an interlock to secure the unloading door in a locked position by means of the locking device when the housing is removed from the document dispenser.

In one embodiment of the cassette of the present invention, the housing thereof includes a main chamber for holding a supply of documents in a stack to be dispensed and also includes a divert chamber for holding documents returned from the document dispenser. The main chamber is provided with an unloading door equipped with a locking device and the divert chamber is provided with a divert door also equipped with a locking device. Both these doors are secured in a locked position by the respective locking devices when the housing of the cassette is removed from the document dispenser.

BRIEF DESCRIPTION OF THE DRAWINGS

For a more complete understanding of the present invention and the advantages thereof, reference is now made to the following description taken in conjunction with the accompanying drawings.

Referring to the drawings

DETAILED DESCRIPTION OF THE INVENTION

Figure 1:
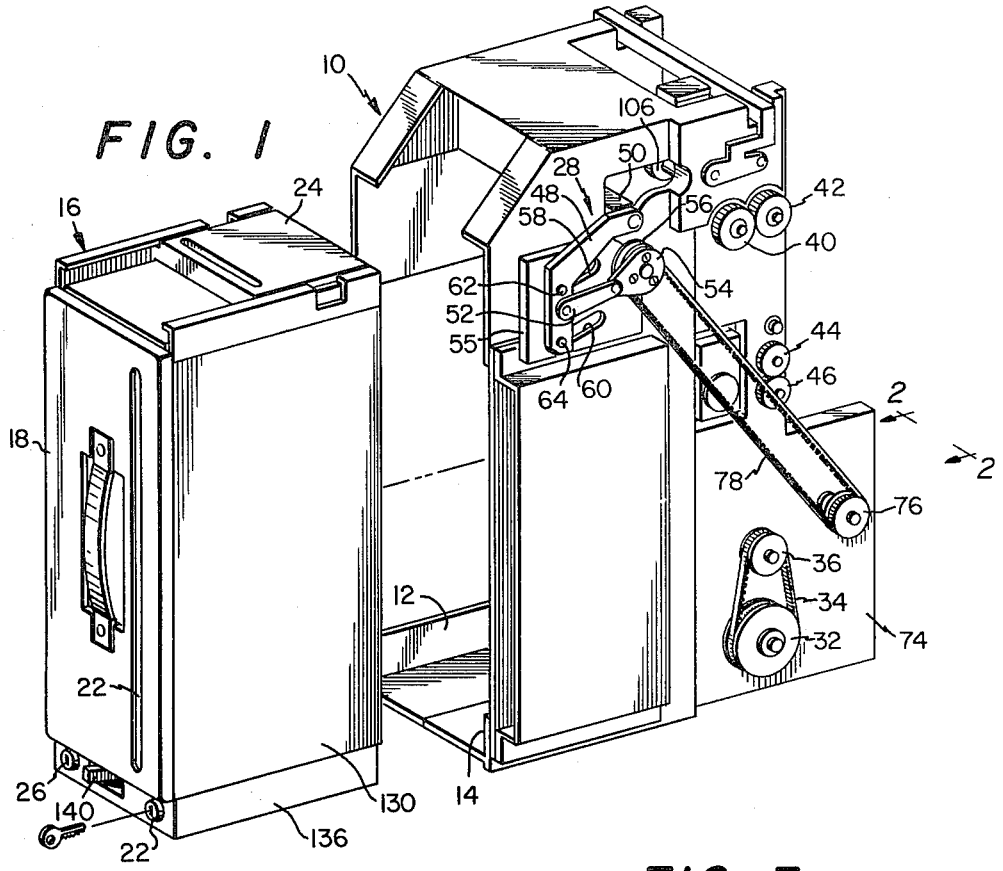
FIG. 1 is a pictorial view of a document dispenser in accordance with the present invention showing a storage cassette removed from the dispenser.

Referring to FIG. 1, the document dispenser of the present invention comprises a housing 10 having internal guide tracks 12 and 14 for locating a document storage cassette 16 in an operating position within the housing 10. The cassette 16 includes a loading door 18 which is secured in the closed position by means of a lock 20. For visually checking the supply of documents within the cassette 16 the door 18 is equipped with a vertically oriented window 22 enclosed with a clear plastic or other non-breakable transparent material. The cassette 16 also includes an unloading door 24 which is locked in a closed position, as will be explained, until the cassette is secured within the housing 10. The unloading door 24 is slid to an open position for removing documents from within the cassette 16.

With the cassette 16 inserted into the housing 10 it is secured in place by means of a lock 26 that mates with a permanently mounted key secured within the housing 10 (not shown in FIG. 1). As explained, when the cassette 16 is secured within the housing 10 the unloading door 24 is slid to an open position thereby enabling removal of documents from within the cassette.

Documents are removed from the cassette 16 by means of a picker mechanism 28 and delivered into a conventional belt transport system such as the one illustrated and described in U.S. Pat. No. 3,937,453, issued Feb. 10, 1976. The transport system includes a double detector (not shown) at the input rollers. The belt transport system is driven by means of a motor 32 through a flexible belt 34 connected to a drive pulley 36. Motion of the drive pulley 36 is transmitted to the belt transport system by means of a shaft 38 that extends into the housing 10. Also included as part of the drive mechanism for the belt transport system are drive gears 40 and 42 and drive gears 44 and 46. Details of the belt transport system are not given inasmuch as such transports are now well known in the art.

Included as part of the picker mechanism 28 is a picker arm 48 attached to a picker head 50 that includes vacuum cups, as will be explained. Motion is imparted to the picker arm 48 through a drive link 52 connected to a crank 54 attached to a drive pulley 56. The profile path followed by the picker arm between its two end positions is controlled by the configuration of an upper cam 58 and a lower cam 60 formed in a side plate 55 attached to the housing 10. Riding in each of the cams 58 and 60 are cam followers 62 and 64, respectively, which are held in the cams by the plate 55. A more detailed description of the picker head 50 will be given with reference to FIGS. 4–8.

Figure 2:
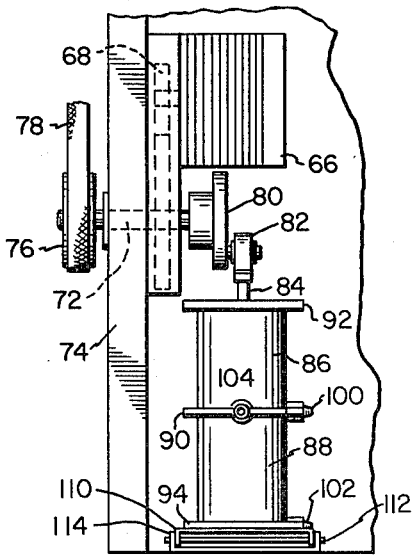
FIG. 2 is a partial front view of the dispenser of FIG. 1 taken along the line 2—2 and illustrating the vacuum/-pressure supply.

Referring to FIG. 2, power for driving the picker head 28 is provided by means of a drive motor 66 having a drive gear 68 coupled to a spur gear 70. The spur gear 70 is mounted to a shaft 72 supported in a wall 74 of the housing 10. Connected to the shaft 72 is a pulley 76 which drives the pulley 56 by means of a flexible belt 78.

Also connected to the shaft 72 is an eccentric 80. The eccentric 80 is connected by means of a coupling 82 to a piston rod 84 as part of a vacuum/pressure supply for the dispenser of FIG. 1.

Figure 3:
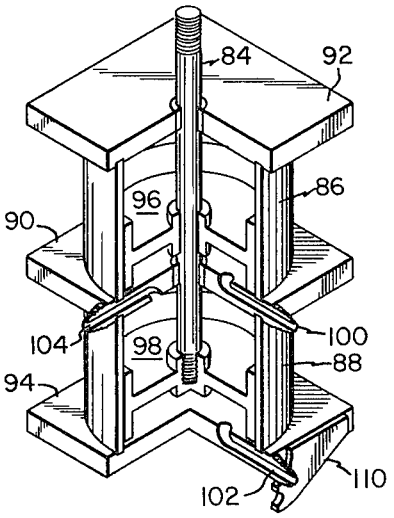
FIG. 3 is a pictorial view partially cut away of the vacuum/pressure pump of FIG. 2.

With reference to FIGS. 2 and 3, the vacuum/pressure supply includes a two-part cylinder (86, 88) separated by an end plate 90, thus forming two separate side-by-side chambers. The chamber of the cylinder 86 is capped by an end plate 92 and the chamber of the cylinder 88 is capped by an end plate 94. Mounted within the cylinder 86 is a piston 96 connected to the piston rod 84 to be moved therewith. Coupled to the piston rod 84 within the cylinder 88 is a piston 98 such that both pistons move within their respective chambers in synchronism.

As best illustrated in FIG. 3, the respective pistons in each of the cylinders 86 and 88 divides each chamber into an upper section and a lower section. Opening into the lower section of the cylinder 86 is a port 100 that is interconnected by means of manifolding to a port 102 that opens into the lower section of the cylinder 88. Opening into the upper section of the cylinder 88 is a port 104 that provides a vacuum/pressure 180° out of phase with respect to the vacuum/pressure produced at the ports 100 and 102. This vacuum/pressure as developed at the ports 100, 102 and 104 is utilized in the dispenser of FIG. 1 to remove a document from the cassette 16 for delivery into the belt transport system.

Figures 4, 5, 6:
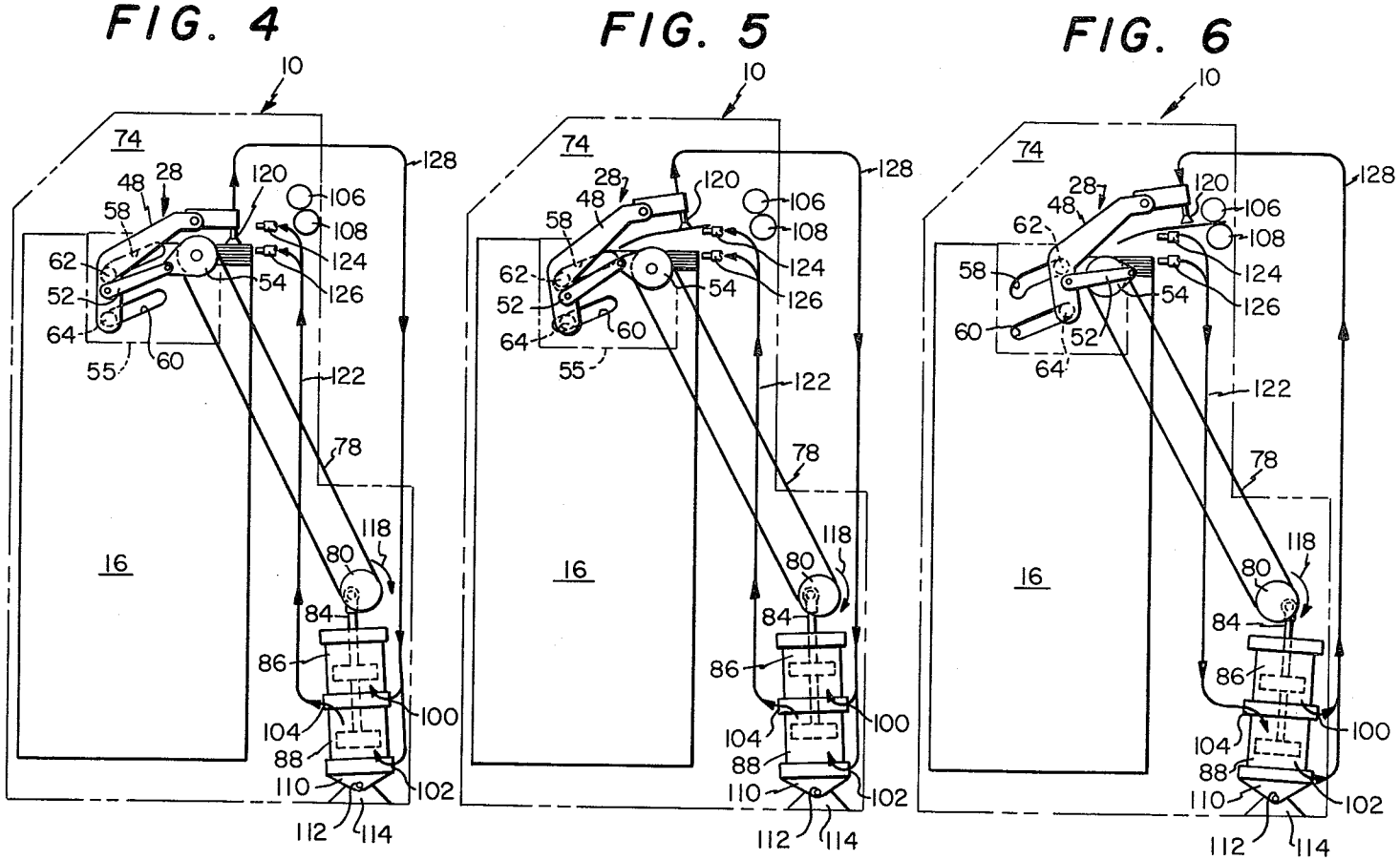
FIGS. 4–6 are a moving illustration of a document picker mechanism for removing documents from the cassette of FIG. 1 for delivery into the transport of the dispenser.

Referring to FIGS. 4–6 there is shown a three-part sequence for illustrating operation of the picker head 28 and the vacuum/pressure supply to remove a document from the cassette 16 into the belt transport system. In this sequence of illustrations the transport system is depicted by the input rollers 106 and 108 which are the first elements of the transport system. Mounted within the housing 10 in the lower right-hand corner (as illustrated) is the vacuum/pressure supply including the cylinders 86 and 88. Attached to the end plate 94 is a mounting bracket 110 having a pivot shaft 112 extending therethrough to engage a mounting support 114. The mounting support 114 is attached to the base 116 of the housing 10. The bracket 110, shaft 112, and support 114 provide a pivotal mount for the cylinders 86 and 88. This pivoting action is produced by motion of the eccentric 80 driving the piston rod 84 and enables the use of a rigid piston rod connected to the eccentric 80.

The eccentric 80 along with the pulley 76 rotate in the direction of the arrow 118 to synchronize the operation of the vacuum/pressure supply and the picker head 28.

Upon receiving an actuating command the drive motor 66 rotates the eccentric 80 and the pulley 76 from the position shown in FIG. 4 in the direction of the arrow 118. When the pistons 96 and 98 are at the downward extent of their travel, the picker head 28 is in a position such that the vacuum cups 120 rests against the top document in the cassette 16. As the pistons move from the downward extent of their travel toward the upward extent of their travel a pressure is generated in the port 104 which is connected by means of a line 122 to nozzles 124 and 126. The nozzle 126 is located at the edge of the top document of the stack within the cassette 16 and thus provides a fluid pressure stream against this edge of the document. The nozzle 124 is positioned above the nozzle 126 and also provides a fluid pressure stream directed against the edge of a document. The pressure stream from the nozzles 124 and 126 produce a separation effect on the first document in the stack from the remaining documents. A fluid pressure stream from the nozzle 126 ruffles the leading edge of the top document to provide a more positive separation of this document from the second document in the stack. As the first document in the stack is lifted toward the rollers 106 and 108 the fluid pressure stream from the nozzle 124 provides a second ruffling of the leading edge of the document as a further means of insuring separation of the top document from the second document in the stack. This separation of documents minimizes the possibility of more than a single document being delivered for one motion of the picker head 28 to the rollers 106 and 108.

As the pistons 96 and 98 are moved toward the upward extended position, a vacuum is generated at the ports 100 and 102 which is coupled by means of a line 128 to vacuum cups 120. Thus, at the same time a pressure is being delivered to the nozzles 124 and 126 a vacuum is being generated at vacuum cups 120. With the vacuum cups 120 resting on the top document of the stack an attraction force is developed between the document and the vacuum cups. Motion of the picker head 28 then produces a lifting action of the first document toward the rollers 106 and 108.

Figure 7:
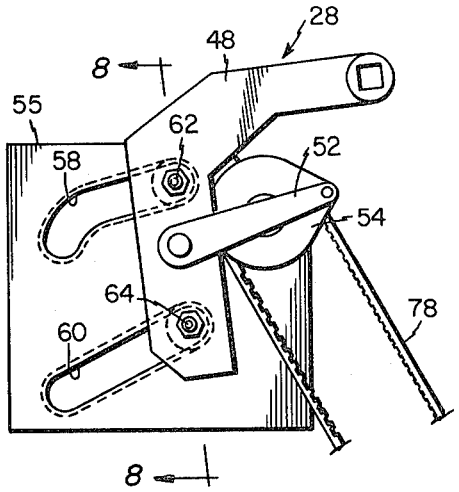
FIG. 7 is a detail of the cam arrangement for determining the profile path of a picker head for the mechanism of FIGS. 4–6.
Figure 8:
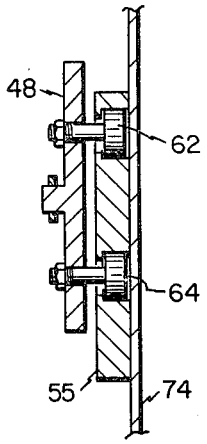
FIG. 8 is a sectional view taken along the line 8—8 of FIG. 7 showing the capture of cam followers.

Referring to FIGS. 4, 7 and 8, the lifting action is provided by means of rotation of the crank 54 which motion is coupled through the connecting link 52 to the picker arm 48. The initial motion of the crank 54 causes the lower picker arm **48*a* to rotate counterclockwise about the cam follower 62 in a first segment of the cam 58. Rotation of the picker arm 48*a* is constrained by the configuration of the cam 60 restricting movement of the cam follower 64**.

With reference also to FIG. 5, as the crank 54 rotates into the position as illustrated, the picker arm 48 has rotated and lifted the leading edge of the first document in the stack from the remaining documents. Continued rotation of the crank 54 then produces a linear motion for the picker head 50 in the direction of the rollers 106 and 108. The angle of the picker head 50 with reference to the document stack is determined by the angular position of the cams 58 and 60 as attached to the sidewall 74 of the housing 10. As the picker head 50 moves along the profile path established by the cams 58 and 60, the pistons 96 and 98 continue in an upward direction producing a pressure in the line 122 and a vacuum in the line 128 as indicated by the arrows. This document-/movement/pressure relationship continues so long as the picker head moves in the angle as illustrated in FIG. 5 towards the rollers 106 and 108.

With reference to FIGS. 6 and 7, when the picker head 50 reaches its most forward position the document adhering to the vacuum cups 120 will be fed into the nip of the rollers 106 and 108. At this time the crank 54 has rotated approximately 180° and the pistons 96 and 98 are at their upward extent of travel. Continued rotation of the eccentric 80 and the pulley 76 in the direction of the arrow 118 now causes the picker head to be returned to its original at-rest position.

As the picker head 50 starts to return to its at-rest position the piston 96 and piston 98 move downward producing a pressure in the line 128 and consequently at the vacuum cups 120. This pressure produces a positive removal of the document from the vacuum cups and provides a more positive movement of the document through the rollers 106 and 108 into the transport system. A vacuum is now generated at the nozzles 124 and 126 but this vacuum is not utilized in the dispensing of a document from the cassette 16. Picker arm 48 continues to move toward the left along the profile path established by the cams 58 and 60 until both cam followers 62 and 64 are in the far left position. The cam follower 62 both in the forward and reverse directions follows the first surface of the cam 58 and then moves into the second surface contiguous with the first. In the preferred configuration of the cam 58 it provides the initial rotating action of the picker arm 48 by motion of the crank 54.

When the picker arm 48 has returned to its at-rest position the drive motor 66 is de-energized and the system is ready for another command to deliver a document from the stack in the cassette 16 into the rollers 106 and 108 of the transport system. The entire delivery operation is synchronized by motion of the pistons 96 and 98 and the picker arm 48.

Figure 9:
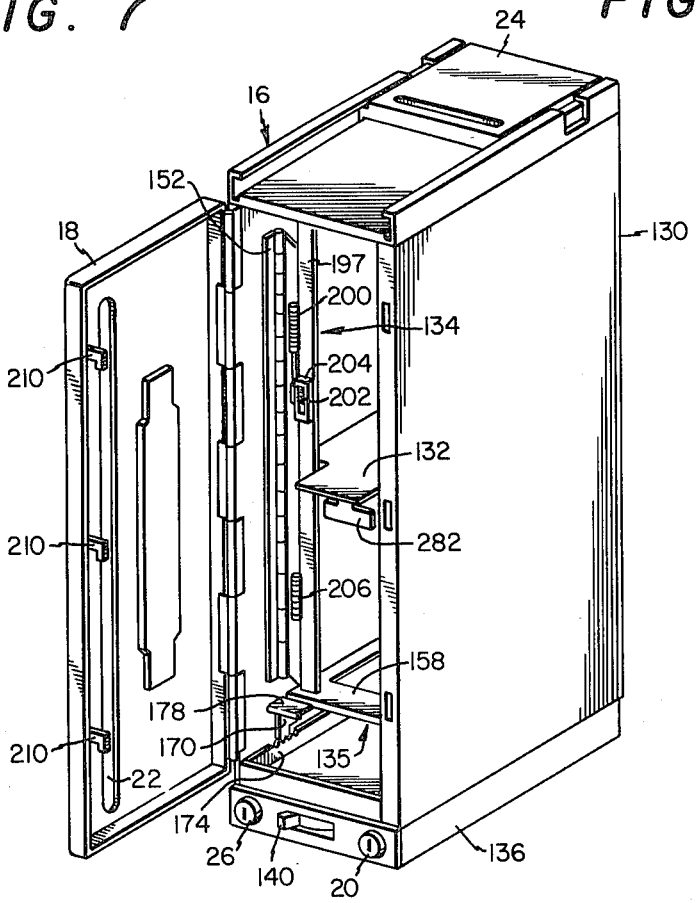
FIG. 9 is a pictorial view of the cassette of FIG. 1 showing the internal elevator mechanism and document width and length adjustment means.

Referring to FIG. 9, there is shown the cassette 16 with the door 18 in an open position for loading documents into the cassette. Internal mechanism within the housing 130 of the cassette 16 includes an elevator 132 for supporting documents as they are removed from the cassette through the unloading door 24. Also included within the cassette is an adjustment mechanism 134 that is positionable to accommodate various lengths of documents (bank notes) on the elevator 132. There is also included within the housing 130 an adjusting mechanism 135 for adjusting the width of documents supported on the elevator 132. This mechanism will be discussed with reference to FIGS. 10 and 11.

The lower portion of the housing 130 includes an enclosure 136 containing a locking device and interlocks for controlling operation of the cassette 16. Included as part of this locking and interlock mechanism is the door lock 20, a cassette lock 138 and a locking knob 140. The lower portion of the housing 130 above the enclosure 136 comprises a divert bin 142 for storage of documents returned from the transport system for various reasons such as the moving of two documents together through the transport system.

Figure 10:
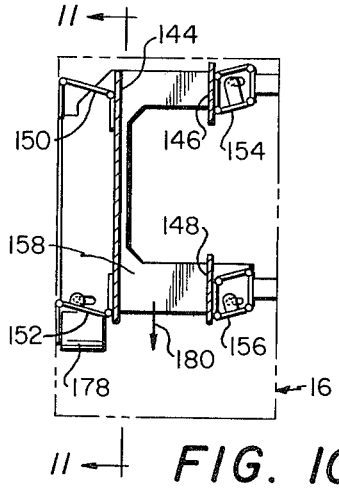
FIG. 10 is a top view in section showing the mechanism for adjusting the width of documents to be accommodated on the elevator.
Figure 11:
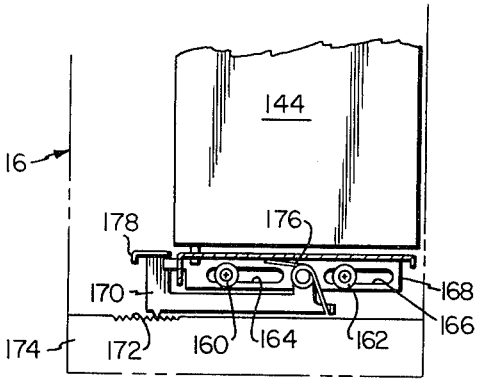
FIG. 11 is a sectional view of the width ajusting mechanism taken along the line 11—11 of FIG. 10.

Referring to FIGS. 10 and 11, there is shown the mechanism for adjusting the width of a document supported on the elevator 132. Basically the width adjustment mechanism is an arrangement of parallel bars that move a guide plate 144 and guide bands 146 and 148 relative to the sidewalls of the housing 130. The guide plate 144 is attached to the sidewall of the housing 130 by double hinges 150 and 152. Each of these double hinges extends substantially the length of travel of the elevator 132 such as shown in FIG. 9 for the double hinge 152. Each of the guide bands 146 and 148 are similarly supported on double hinges 154 and 156, respectively. These hinges are attached to the sidewall of the housing 130.

With specific reference to FIG. 11, there is shown the mechanism for adjusting the position of the guide plate 144 and the guide bands 146 and 148. The double hinges 150, 152, 154 and 156 are pivotally mounted to a support plate 158 that in turn is mounted to the sidewall 130 of the cassette housing by means of fasteners 160 and 162 mounted in elongated slots 164 and 166, respectively. These elongated slots 164 and 166 are in a bracket 168 extending downwardly from the plate 158.

Pivotally mounted to the bracket 168 is an adjustment lever 170 that includes a positioning pawl 172. The positioning pawl 172 engages a serrated adjustment bar 174 mounted to the sidewall of the housing 130, such as shown in FIG. 9. The adjustment lever 170 is spring loaded into engagement with the serrated bar 174 by means of a spring 176. A finger 178 attached to the lever 170 enables an operator to adjust the distance between the plate 144 and the bands 146 and 148 by a single motion.

To make the adjustment to accommodate various widths of documents on the elevator 132, the finger tab 178 is rotated to lift the positioning pawl 172 free of the serrations in the bar 174. By pulling or pushing on the finger tab 178 the support plate 158 is moved relative to the housing walls of the cassette 16. This causes a change in the angular configuration of various segments of the double hinges 150, 152, 154 and 156, thereby moving the plate 144 and the bands 146 and 148 closer together or farther apart to accommodate different widths of documents on the elevator 132. By releasing the finger tab 178 the positioning pawl 172 again engages the serrations in the bar 174 to establish a fixed distance between the plate 144 and the bands 146 and 148.

Figure 12:
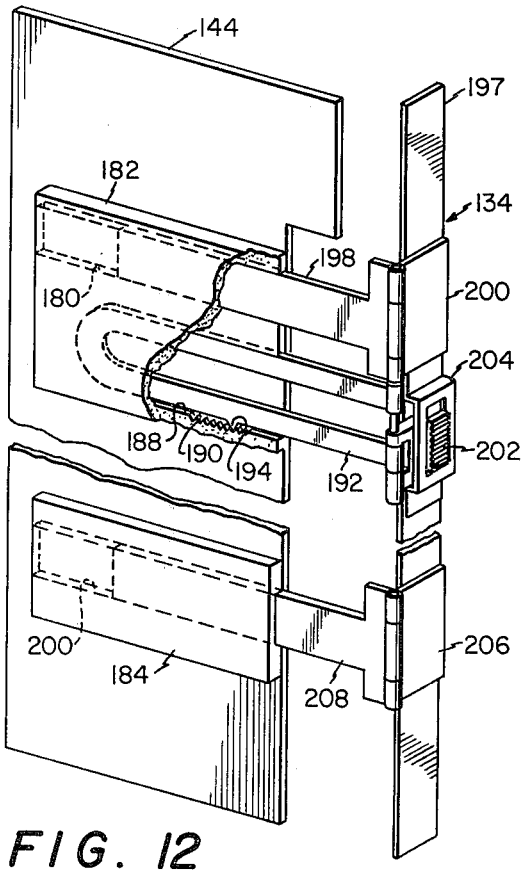
FIG. 12 is a pictorial view partially cut away showing the mechanism for adjusting the length of documents to be accommodated on the elevator of the cassette.

Referring to FIG. 12, there is shown in detail the adjustment mechanism for accommodating various lengths of documents on the elevator 132. Attached to the guide plate 144 are guide brackets 182 and 184. In addition to including a guide channel 186 the guide bracket 182 also includes a channel 188 having a serrated section 190. Slidably mounted within the channel 188 is a U-shaped adjustment bar 192 having a positioning pawl 194 for engaging the serrated section 190. One end of the U-shaped adjustment bar 192 is attached by means of a hinge 196 to an end bar 197. The second end of the U-shaped adjustment bar 192 is attached by means of a hinge 196 to an adjustment tab 202. The adjustment tab is constrained to move within a slide bracket 204 which is attached to an end bar 197.

Also attached to the end bar 197 by means of the hinge 200 is a guide bar 198 slidably mounted within the channel 186.

Mounted to the adjustment bar 197 below the bracket 204 is a hinge 206 which extends into a guide bar 208. The guide bar 208 is slidably mounted within a channel 210 of the guide bracket 184.

To adjust for the length of documents on the elevator 132 the tab 202 is pushed upward to disengage the adjustment pawl 194 from the serrated section 190. The end bar 197 can then be positioned by sliding the guide bars 198 and 208 in their respective channels. When the position of the bar 197 accommodates the length of documents on the elevator 132 the tab 202 is released thereby allowing the positioning pawl 194 to engage the serration section 190.

To load documents onto the elevator 132 the end bar 197 is rotated in alignment with the guide plate 144 by means of the hinges 196, 200 and 206. Thus, by means of the finger tab 178 and the tab 202 both the width and length may be adjusted to accommodate various sized documents (bank notes) in the cassette 16.

Figure 13:
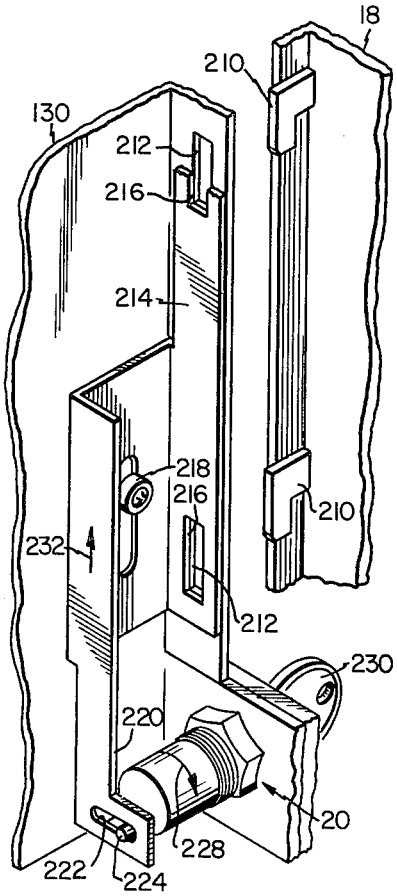
FIG. 13 is a pictorial view partially cut away showing the door lock mechanism of the cassette.

Referring to FIG. 13, to provide a tamper-proof cassette the door 18 is provided with latch togs 210 positioned along the edge of the door 18 opposite the hinge mounting. When the door is in the closed position the latch togs 210 pass through openings 212 in the end wall of the housing 130. Slidably mounted within the housing immediately inside the end wall is a sliding bar 214 that includes openings 216 equal in number to the openings 212. The sliding bar 214 is mounted to the housing 130 by means of a fastener 218.

Extending from the lower portion of the sliding bar 214 is an L-shaped section 220 that includes a cam 222. The cam 222 is engaged by a cam follower 224 mounted on a rotating cylinder 226. The cylinder 226 is part of the lock 20 and rotates in the direction of the arrow 228 by means of the key 230.

When the door is in the closed position an operator rotates the key 230 thereby causing the sliding bar 214 to slide upward in the direction of the arrow 232 to cause the openings 216 to secure the latch togs 210 and thus the door 18 to the housing 130. Thus, the door 18 is now in a locked position insuring the security of documents within the cassette 16.

Figure 14:
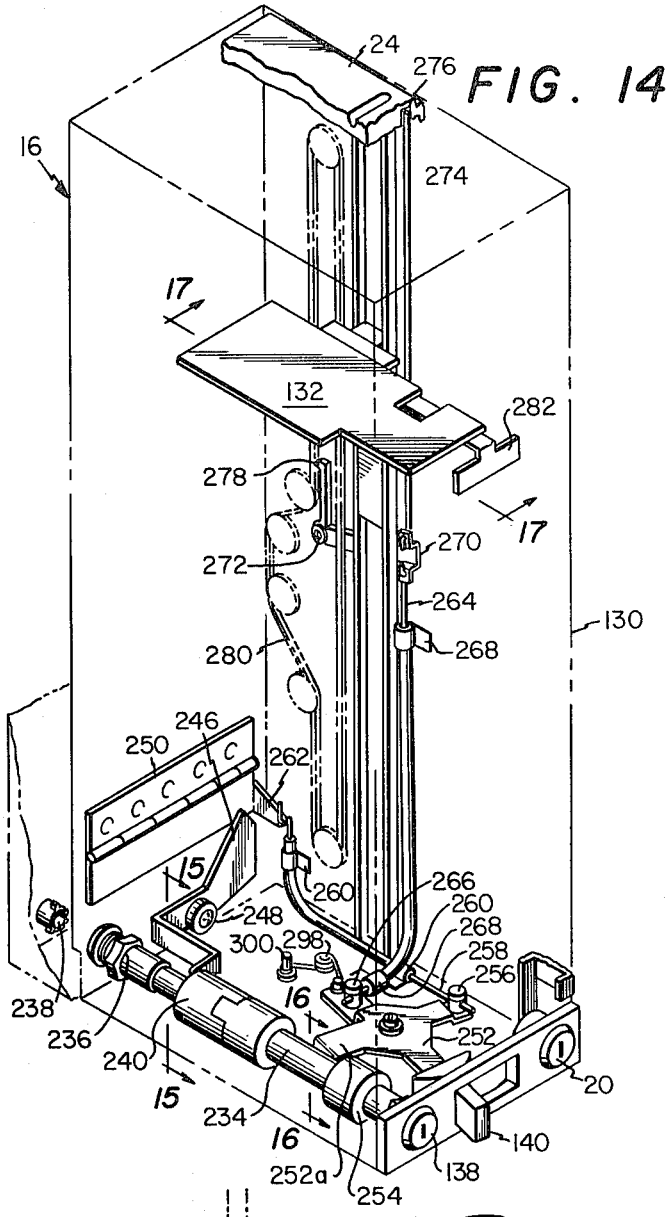
FIG. 14 is a pictorial view for the interlock mechanism for the cassette showing the housing in dotted outline.
Figure 15:
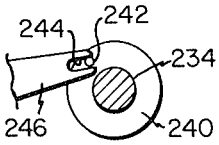
FIG. 15 is a section partially cut away of the locking mechanism for the divert door of the cassette.
Figure 16:
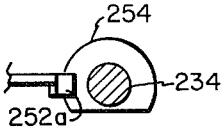
FIG. 16 is a sectional view partially cut away of the master lock mechanism for configuring the cassette to the ready condition for unloading of documents therefrom.

Referring to FIGS. 14–16, there is detailed the lock and interlock mechanisms for securing the cassette 16 within the dispenser to provide a tamper-proof configuration. Shown within the chamber 136 is the lock 138 which operates an interlock shaft 234 extending to a dispenser lock 236. The dispenser lock 236 is positioned to engage a key 238 that is permanently secured in the dispenser of FIG. 1. As the cassette is slid into place within the dispenser the key 238 engages the lock 236. Rotating the lock 138 locks the key 238 within the lock 236 thereby securing the cassette within the dispenser.

With specific reference to FIG. 15, attached to a coupling 240 as part of the shaft 234 is a pin 242. This pin engages a slot 244 within a latch bracket 246 attached to the end wall of the housing 130 by means of a fastener 248. The bracket 246 is rotatably mounted by means of the fastener 248. Rotating the coupling 240 with the shaft 234 also rotates the bracket 246 in a clockwise direction as viewed from the inside of the cassette 16.

With the bracket 246 in the position as illustrated in FIG. 14 it provides a lock for a divert door 250. The divert door provides access to the divert bin 142 of the cassette 16. This door will be opened only when the cassette 16 is in an operating condition for removal of documents through the unloading door 24. Thus, when the lock 138 is rotated causing the shaft 234 and the coupling 240 to likewise rotate the bracket 246 rotates to clear the divert door 250. Note, however, that the divert door is still in the closed position.

Rotatively mounted to the bottom of the housing 130 of the cassette 16 is an X-shaped locking lever 252 that has attached to one arm thereof the locking knob 140. The locking lever 252 is constrained from rotating by means of an arm **252*a* engaging the shoulder of a lock stop 254. This lock stop 254, as best shown in FIG. 16, is secured to the shaft 234 and rotates therewith by means of the lock 138. Rotating the lock 138 to secure the cassette 16 within the dispenser by means the lock 236 and key 238 also rotates the lock stop 254 90 degrees clockwise from the position shown in FIG. 16. This frees the arm 252*a* from the obstruction caused by the lock stop 254 and pushing the locking knob 140 toward the lock 20 causes the locking lever 252 to rotate from the position shown. The locking lever 252** will then be in the second of its two stable positions.

To maintain the locking lever 252 in its first and second stable positions, a spring 298 is attached to one end to the bottom of the housing 130 by means of a pin 300 and at the opposite end to the locking lever 252 by means of a pin 302. The spring 298 thus provides a toggle action for the locking lever 252 to provide two stable positions thereto. The one stable position is as illustrated in FIG. 14 and the second stable position is with the locking knob 140 moved toward the lock 20.

Attached to one arm of the locking lever 252 is a sheathed cable 258 by means of a swivel coupling 256. The sheathed cable is attached to the bottom and side walls of the housing 130 by means of mounting clips 260.

The second end of the sheathed cable 258 is attached to the divert door 250 by means of a bracket 262. By rotating the locking lever 252 from its stable position as illustrated in FIG. 14 to its second stable position the lower half of the divert door 250 is rotated upwardly thereby providing access to the divert bin 142 such as shown in FIG. 1.

Attached to an arm of the mounting lever 252 opposite the locking knob 140 is a sheathed cable 264 by means of a swivel coupling 266. The sheathed cable 264 is attached to the housing 130 by means of brackets 268.

The end of the cable 264 opposite the coupling 266 is attached to an L-shaped bracket 270 rotatively mounted to the sidewall of the housing 130 by means of a pin 272. Opposite the attachment of the cable 264 on the bracket 270 is a pushrod 274 that engages a notch 276 within the unloading door 24. With the pushrod 274 inserted into the notch 276 the unloading door 24 is secured in the closed position thus preventing access to documents within the cassette 16. The lock position of the unloading door 24 is illustrated in FIG. 14.

The second arm of the bracket 270 terminates in a locking pawl 278 that is positioned to engage an elevator chain 280 as part of the lift mechanism for the elevator 132. When the locking pawl is in the position shown the elevator chain cannot be moved thereby preventing operation of the elevator 132. Thus, when the cassette is removed from the dispenser and the locking knob 140 is in the position illustrated in FIG. 14, the pushrod 174 locks the unloading door 24 into a closed position and the locking pawl 278 secures the elevator in its last position.

When the cassette is secured into the dispenser by means of the key 238 engaging the lock 236 the locking knob 140 is movable to its second position thereby rotating the locking lever 252. Rotating the locking lever 252 causes rotation of the bracket 270 to release the locking pawl 278 from the elevator chain 280 and also to displace the pushrod 274 from the notch 276. This enables an operator to open the unloading door 24 preparing the cassette for the dispensing of documents therefrom.

Figure 17:
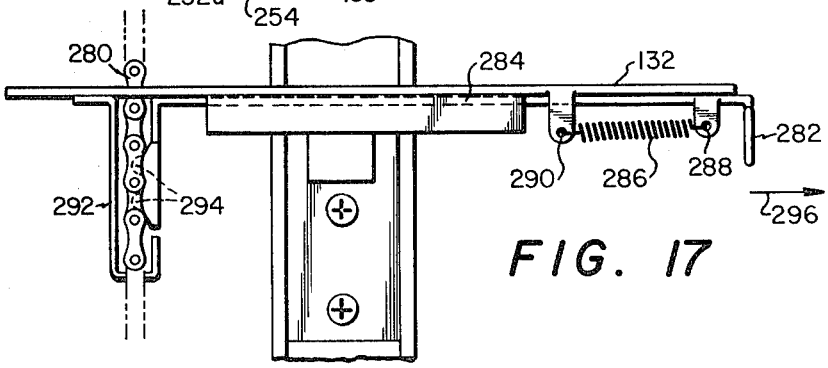
FIG. 17 is a sectional view partially cut away showing the elevator adjust mechanism taken along the line 17—17 of FIG. 14.

Referring to FIG. 17, with the elevator chain 280 locked by means of the pawl 278 the elevator 132 is positionable manually within the cassette by means of a pull tab 282. The pull tab 282 is formed at one end of a slidably mounted bracket 284 secured to the underside of the elevator 132. The bracket 284 is spring loaded into the position illustrated by means of a spring 286 attached to a tab 288 as part of the bracket 284 and a tab 290 secured to the underside of the elevator 132.

At the end of the bracket 284 opposite the pull tab 282 there is attached a U-shaped retainer 292 that encircles the elevator chain 280. The U-shaped retainer 292 includes positioning buttons 294 that engage the chain 280 when in the position shown. When in this position the elevator 132 will move up or down with movement of the elevator chain. To position the elevator 132 manually, the pull tab 182 is moved in the direction of the arrow 296 thereby releasing the positioning buttons 294 from the chain 280. The elevator 132 may now be raised or lowered in the cassette 16 and the pull tab released. Releasing the pull tab re-engages the positioning buttons 294 to engage the chain 280.

Although a preferred embodiment of the invention has been illustrated in the accompanying drawings and described in the foregoing Detailed Description, it will be understood that the invention is not limited to the embodiment disclosed but is capable of numerous rearrangements, modifications and substitutions without departing from the scope of the invention.

We claim:

1. A vacuum/pressure supply, comprising in combination:

a cylinder having first and second chambers each containing a sliding piston, means for interconnecting the piston of each chamber into a single operating unit, a first port in each chamber opening therein on the same side of the piston in the respective chamber, means for interconnecting the first port of each chamber into a first vacuum/pressure supply source, a second port in one of said chambers opening therein on the side of the piston opposite the first port, said second port providing a second vacuum/pressure supply source 180° out of phase with the first vacuum/pressure supply source, and means for pivotally mounting the cylinder for oscillating action when driving the pistons relative to the respective chambers, wherein during a first portion of said oscillating action said first and second vacuum/pressure supply sources produce a vacuum and fluid pressure respectively, said first and second vacuum/pressure supply sources producing fluid pressure and a vacuum, respectively, during a second portion of said oscillating action.

2. A vacuum/pressure supply as set forth in claim 1 including means for driving the pistons of each chamber relative to the respective chamber.

3. A vacuum/pressure supply as set forth in claim 2 wherein said means for driving includes a rotating eccentric connected to a solid piston rod for interconnecting the pistons of each chamber.

4. A vacuum/pressure supply for a document dispenser having a vacuum cup as part of a picker head for removing a document from a stack, comprising in combination:

a cylinder having first and second chambers each containing a sliding piston, means for interconnecting the piston of each chamber into a single operating unit, a first port in each chamber opening therein on the same side of the piston in the respective chamber, a manifold for interconnecting the first port of each chamber into a single vacuum/pressure supply source, means for interconnecting said manifold to the vacuum cup of the picker head, means for driving the pistons of each chamber relative to the respective chamber and the picker head for removing a document from the stack, and means for pivotally mounting the cylinder for oscillating action when driving the pistons relative to the respective chambers, wherein a vacuum is applied to said vacuum cup by said vacuum/pressure supply source during a first portion of said oscillating action, said vacuum/pressure supply source applying a pressure to said vacuum cup during a second portion of said oscillating action.

5. A vacuum/pressure supply for a document dispenser as set forth in claim 4 wherein the document dispenser includes a transport and further including means for synchronizing the movement of the picker head with the driving of the pistons during said first and second portions of said oscillating action such that said vacuum is applied to the vacuum cup when removing a document from the stack for the transport and said pressure is applied to the vacuum cup when a document has been placed in the transport.

6. A vacuum/pressure supply for a document dispenser as set forth in claim 4 wherein said means for driving include means for limiting each piston to a complete cycle for each document dispensed into the document transport.

7. A vacuum/pressure supply for a document dispenser having vacuum cups as part of a picker head for removing a document from a stack, comprising in combination:

a document separator positioned at the document stack for producing a separating effect for one document from the remaining documents in the stack, a cylinder having first and second chambers each containing a sliding piston, means for interconnecting the piston of each chamber into a single operating unit, a first port in each chamber opening therein on the same side of the piston in the respective chamber, a manifold for interconnecting the first port of each chamber into a first vacuum/pressure supply source, means for interconnecting said manifold to the vacuum cups of the picker head, a second port in each chamber opening therein on the side of the piston opposite the first port, said second port providing a second vacuum/pressure supply source 180° out of phase with the first vacuum/pressure supply source, means for interconnecting at least one of the second ports to the document separator, means for pivotally mounting the cylinder for oscillating action when driving the pistons relative to the respective chambers, and means for driving the picker head for removing a document from the stack and for driving the pistons of each chamber relative to the respective chamber for producing a vacuum to the vacuum cups and a pressure to the document separator during a first portion of said oscillating action, and for producing a pressure to the vacuum cups and a vacuum to the document separator during a second portion of said oscillating action.

8. A vacuum/pressure supply for a document dispenser as set forth in claim 7 wherein said document separator comprises a nozzle positioned to direct a pressure stream against one edge of the document stack.

9. A vacuum/pressure supply for a document dispenser as set forth in claim 7 including means for synchronizing the movement of the picker head with the driving of the pistons during said first and second portions of said oscillating action such that said vacuum is applied to the vacuum cups when removing a document from the stack and said pressure is applied to the vacuum cups when a document has been removed from the stack.

10. A vacuum/pressure supply for a document dispenser as set forth in claim 9 wherein said means for pivotally mounting includes a rocker mount for the cylinder to enable pivotal action thereof when driving the pistons relative to the respective chambers.

* * * * *